United States Patent [19]

Schliep

[11] 4,383,684

[45] May 17, 1983

[54] WEIGHT MOVING DEVICE

[76] Inventor: Edward J. Schliep, 3218 Twin City Dr., Mandan, N. Dak. 58554

[21] Appl. No.: 235,020

[22] Filed: Feb. 17, 1981

[51] Int. Cl.[3] ..... A63B 21/00

[52] U.S. Cl. ..... 272/120; 272/DIG. 4; 272/123; 272/134; 272/145

[58] Field of Search ..... 272/127, 126, 121, 134, 272/143, 144, 145, DIG. 4, 130

[56] References Cited

U.S. PATENT DOCUMENTS 2,129,262 9/1938 Cole ..... 272/134 X 4,004,801 1/1977 Campanaro et al. ..... 272/134 X 4,101,124 7/1978 Mahnke ..... 272/134

*Primary Examiner*—Richard C. Pinkham

*Assistant Examiner*—William R. Browne

*Attorney, Agent, or Firm*—Schwartz, Jeffery, Schwaab, Mack, Blumenthal & Koch

[57] ABSTRACT

An exercise device which includes a single mounting rail, a support post for supporting one end of the rail at selected elevations, a carriage having rollers for travelling along the rail, and a pulley arrangement having pulleys attached to the support as well as lines which extend through the pulleys from the carriage and back to the carriage for moving the carriage along the rail.

13 Claims, 5 Drawing Figures

WEIGHT MOVING DEVICE

BACKGROUND OF THE INVENTION

This invention generally relates to an exercise device and more particularly to an exercise device utilizing the body weight of a human user to provide a variable resistance.

A growing body of research demonstrates the positive health benefits, both physical and mental, derived from moderate exercise. A wide variety of exercise devices are known adapted to use in a multiplicity of different exercises for strengthening various muscle groups of the body. Traditionally, these devices were available only at professional gymnasiums due to high costs, size and permanent installation requirements. The increased awareness of the benefits derviced by exercise has given rise to the development of home exercise devices which are lightweight, inexpensive and portable in nature.

The prior art, such as U.S. Pat. No. 3,658,327, discloses an exercising device wherein the body weight of the user is employed as the resistance against which muscles are exerted. The device comprises a body support board having rollers for travelling along an inclined, dual track assembly. The user reclines or sits upon the board and pulls or propels the board along the incline the order to exercise different muscle groups of the body. The device is collapsible and therefore portable. Although the arrangement eliminates many of the above-noted problems, the basic structure of the inclined dual track assembly is complicated and therefore somewhat expensive to manufacture. Further, the ladder structure used to elevate one end of the dual track assembly prohibits high angles of inclination, and the number of exercising regimes performable is limited.

U.S. Pat. No. 3,892,404 discloses a device similar to the one discussed above and includes foot resting devices extending between and substantially perpendicular to the dual tracks of the inclined plane. Although this arrangement provides increases versatility, the device suffers from the same basic drawbacks as the exercising device disclosed in U.S. Pat. No. 3,682,475. Moreover, neither of the prior art devices noted can be converted into a weight lifting bench. Further, although exercising boards are known wherein the angle of the board can be adjustably changed, such as disclosed in U.S. Pat. No. 3,545,748, it is known to mount such a structure on an incline so as to reciprocate.

SUMMARY OF THE INVENTION

It is an object of the present invention to provide an exercise device which overcomes the abovenoted deficiencies of the prior art.

Another object of the present invention is to provide an exercise device having a single mounting rail structure and post arrangement which allows a cushioned board to be movably mounted in either a horizontal configuration or at selected angles of inclination.

Yet another object of the present invention is to provide an exercise device having a cushioned board wherein the angle between the rail structure and the board is selectively variable.

Still another object of the present invention is to provide an exercise device having auxiliary legs which support the single rail structure in a horizontal position and which are capable of being surmounted above the cushioned board for use in additional exercise regimes.

Still another object of the present invention is to provide an exercise device which is collapsible and esily portable.

The invention affords several advantages when compared with prior art devices of the same general type. First, the provision of pivotable foot holders mounted upon the post support providing additional versatility. Second, the single mounting rail structure can be situated at high angles of inclination without removal from the supporting post arrangement. Further, the single rail structure including the cushioned board can be mounted in a horitzontal configuration and used as a weight lifting bench. Moreover, the rail structure need not be detached from the supporting post while changing the angle of inclination. Still further, and important, the present invention features low cost of manufacture, portability, and ease of conversion to its many different forms of exercise.

In accordance with the principals of the present invention, the exercise device comprises a single mounting rail, a support post for supporting one end of the rail at selected elevations, a carriage having rollers for travelling along the rail, and a pulley arrangement having pulleys attached to the support as well as lines which extend through the pulleys from the carriage and back to the carriage for moving the carriage along the rail. Pivotal foot holders are connected to the support post for securing the user's feet to the device. Additionally, the carriage includes a body support surface and means for selectively varying the angle of the body support with respect to the rail surface. Mounting means are provided at the end of the rail opposite to the support post for mounting auxiliary legs to situate the mounting rail in a horizontal position for use as a weight lifting bench. The mounting means can also be used to surmount the auxiliary legs above the carriage to be used in a variety of different exercises. The entire assembly is adapted to be easily assembled or disassembled and occupies a small space for storage.

BRIEF DESCRIPTION OF THE DRAWINGS

The foregoing and other objects, features, and advantages of the invention will be apparent from the following and more particular description of the preferred embodiments of the invention, as illustrated in the accompanying drawings in which like reference characters refer to the same parts throughout different views. Referring to the drawings.

DESCRIPTION OF THE PREFERRED EMBODIMENTS

Figure 1:
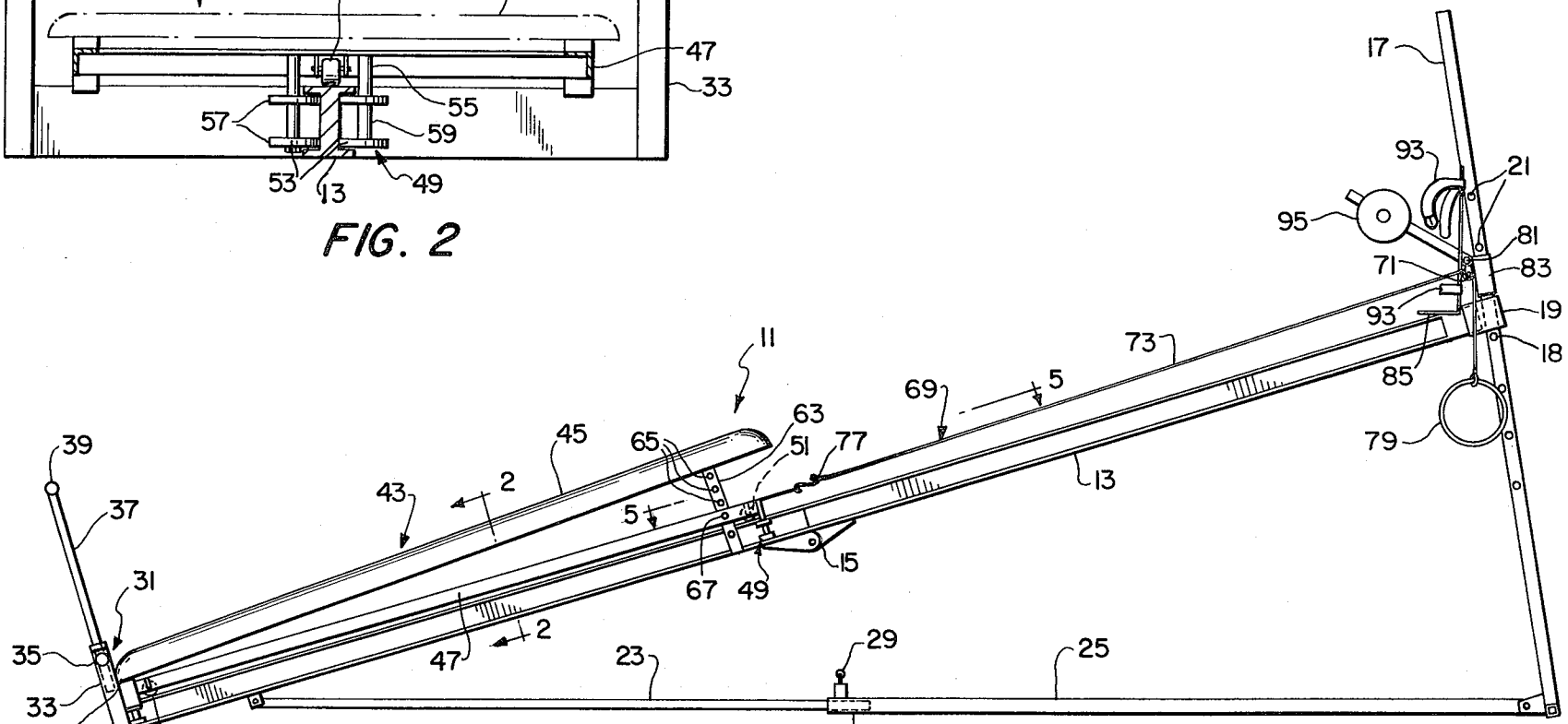
FIG. 1 is a side elevational view of the present invention.

Referring to FIG. 1, an exercise device generally indicated at 11 comprises a mounting rail 13 hinged at 15 to permit folding. The rail 13 may take the form of a tube having a rectangular, cross-sectional configuration, or an I-beam. When not in use, the rail 13 can be folded for shipping, storage, and the like.

One end of the rail 13 is supported on the ground or floor, while the opposite end thereof is supported by a support post 17. A connector 19 removably attaches the rail 13 to the support post 17 and can take the form of a flat iron strap which loosely wraps around the support post 17 allowing the rail 13 to move along the length of the support post 17. The end of the rail 13 next to the support post 17 is preferably cut at an angle to prevent binding during movement along the length of the support post 17.

Through holes 21 are provided at selective locations along the length of the support post 17 and are adapted to accommodate a pin 18 which extends entirely through a selected opening 21. To set the angle of inclination of the rail 13, the pin is inserted in a selected hole 21 so that the bottom of the connector 19 rests upon the pin to prevent downward movement along the length of the support post 17. In order to change the angle of inclination of the rail 13, one need only remove the pin and situate the rail 13 at the selected angle of inclination by sliding the rail 13 along the length of the support post 17. Thereafter, the pin is reinserted in the appropriate hole 21. The operation does not require the separation of the rail 13 from the support post 17 and therefore can be accomplished with ease.

Structural members 23, 25 are pivotally connected to the rail structure 13 and the bottom of the support post 17, respectively. The members 23, 25 are telescopically connected at 27 and secured together by a suitable arrangement such as a screw 29. The inclination of the post 17 can be thus be controlled to permit adjustment of the connector therealong, as desired. As shown in FIG. 1, the members 23 and 25 rest on a supporting surface to provide stability for the device.

Figure 3:
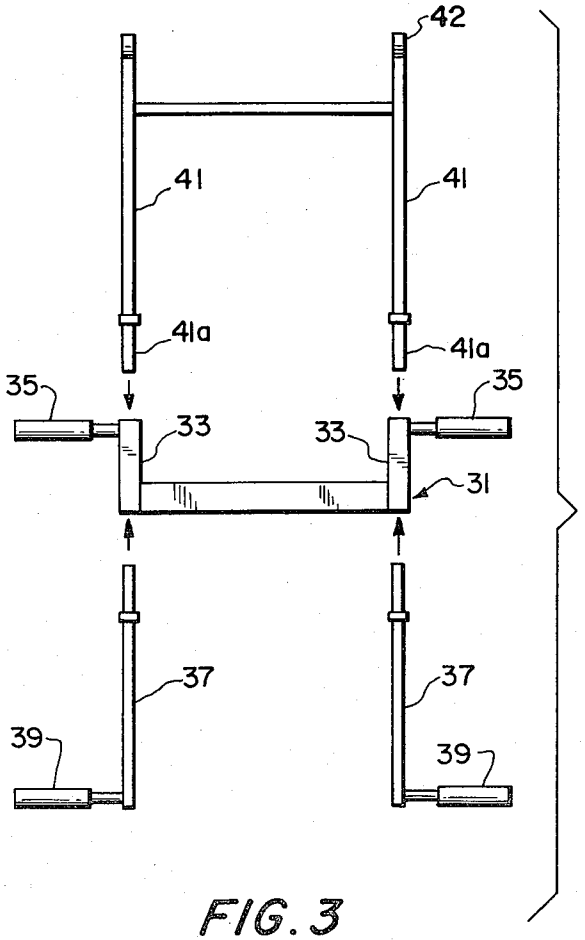
FIG. 3 is a exploded view of the mounting means, auxiliary legs, and weight lifting bench conversion arrangement of the present invention.

A mounting arrangement generally indicated at 31 is situated at the end of the rail 13 supported by the ground or floor, and includes a pair of vertical, hollow posts 33 as shown in FIG. 3. Each post 33 is provided with a handle arm 35 for facilitating handling of the exercise device 11 as well as for use during a variety of different exercises.

Auxiliary legs 37 have portions 37*a* which telescope into the hollow posts 33 to support the rail 13 in a substantially horizontal configuration. Each auxiliary leg 37 includes a handle arm 39 for use during a variety of exercises when the auxiliary legs 37 are surmounted above the rail structure 13 as shown in FIG. 1.

When the auxiliary legs are used to support the mounting rail 13 in a substantially horizontal configuration, the exercise device 11 may be used as a weight lifting bench. A bar bell support comprising legs 41 can be mounted above the rail 13 by means of telescoping leg portions 41*a* which extend into the hollow posts 33, as can be seen in FIG. 3. The legs 41 are cradle-shaped at the tops thereof as shown at 42 to receive the bar of the bar bell (not shown).

Figure 2:
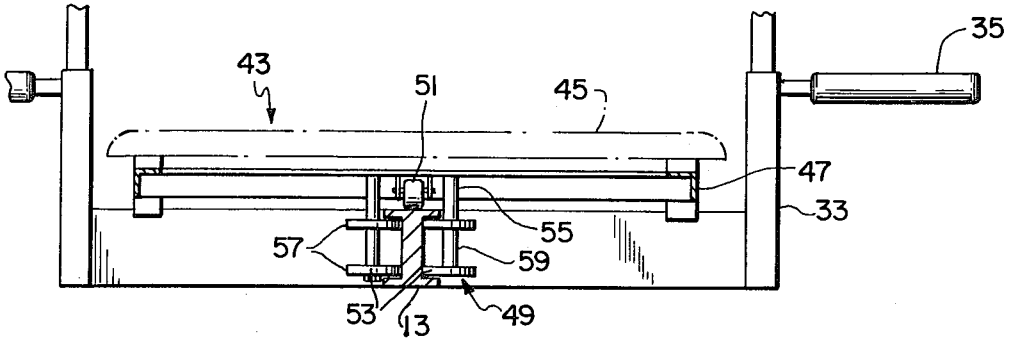
FIG. 2 is a cross-sectional view of the carriage taken along lines 2—2 of FIG. 1.
Figure 5:
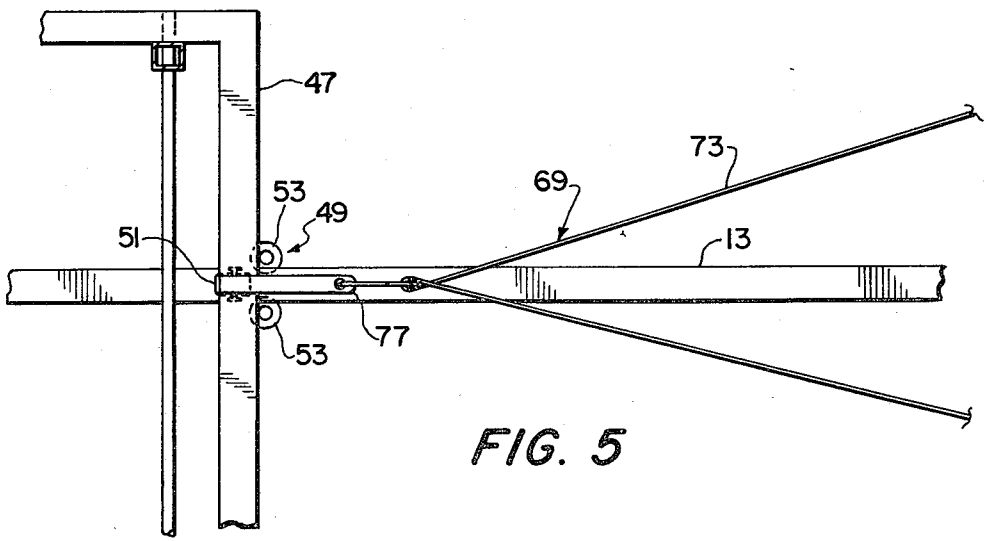
FIG. 5 is a fragmentary top view of the present invention taken along lines 5—5 of FIG. 1.

Referring to FIGS. 1, 2, and 5, a detachable carriage generally indicated at 43 comprises a cushioned body support board 45 and a frame 47 removably mounted to the rail 13 by roller assemblies generally indicated at 49 situated at the front and rear of the frame 47. Each assembly 49 comprises a rotatable riding bearing 51 adapted to roll along the top of the single rail 13 and a pair of rotatable roller bearings 53 adapted to engage the vertical sides of the rail 13. Each roller bearing 53 includes a bolt 55 extending downwardly from and substantially perpendicular to the frame 47 and a pair of bearings 57 rotatably mounted on the bolt 51 and spaced by a spacer 59. The roller bearings 53 function to maintain the carriage in a path of straight movement as it rolls along the rail 13.

The body support board 45 is pivotally mounted at its rear end to the frame 47 by means of a hinge 61, and is supported at its front end by a pair of supports 63 having vertically spaced holes 65. The support 63 may be attached to the frame by means of a pin 67 which extends through a preselected one of the holes 65. The angle of the support board 45 with respect to the frame 47 can thus be varied.

Figure 4:
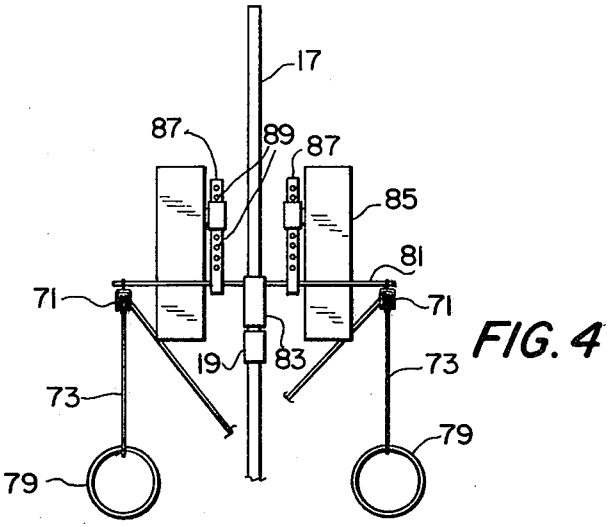
FIG. 4 is a front view of the pulley assembly and pivotal foot holders of the present invention.

The carriage 43 is operatively connected to the support post 17 by a pulley arrangement generally indicated at 69 including a pair of pulleys 71 attached to the support post 17 (FIG. 4), and a cord 73 extending through a hook or clamp 77 provided at the forward end of the carraige 43. The core 73 extends forwardly from the carraige 43 through the pulleys 71 and back to the carriage 43. The ends of the cord 73 are provided with handles 79 for grasping by the user.

The pair of pulleys 71 are removably affixed by clips or other suitable means to a cross bar 81 attached to the support post 17 by means of a sleeve 83 slidable along the length of the support post 17. The sleeve 83 rests upon the top of the connector 19 so that the distance between the rail 13 and the pulleys 71 is always the same regardless of the angular orientation of the rail.

Foot holders 85 are pivotally attached to the horizontal bar 81 by supports 87 which extend loosely around the bar adjacent the bottom ends thereof. The supports are formed with a plurality of vertically spaced holes 89. Each foot holder 85 is provided with a suitable connector 91 for selectively engaging one of the holes 89 so that the vertical positioning of the foot holders 85 with respect to the bar 81 can be varied as desired. Each foot holder 85 is provided with a pair of straps 93 for securing the user's feet to the foot holder 85. Alternatively, an adjustable pad 95 may be used to secure the user's feet to the foot holders 85.

Since the foot holders 85 are pivotally mounted on the bar, they may be turned around to allow the user to lie on the cushioned board on his stomach and perform a variety of different exercises.

Further, the handles 79 may be replaced by a head harness (not shown) adapted to attach the user's head to the cord 73 while performing a variety of different exercises designed to improve the neck muscles.

In normal use, the exercise device 11 is set-up as illustrated in FIG. 1 with one end of the rail 13 supported by the support post 17 a distance above the ground or floor. The user reclines or sits on the body support board 45 of the carriage 43, facing either direction, and grasps handles 79 pulling them towards the carriage 43 to move the carriage 43 upwardly along the rail 13. Alternatively, exertion may be expended against the handles 35 of the mounting means 31 by placing one's feet or hands against the handles 35 and moving the carriage 43 up the incline.

The foot holders 85 can be utilized by the user to perform sit-ups on an incline by attaching the user's feet to the foot holders 85 with straps 93. Further, the foot holders can be turned around allowing the user to lie on the cushioned board with his head down to perform leg pullups. The user may situate himself on the board 45 either face down or face up.

Thigh and calf exercises are performed by mounting the cushioned board 45 so that the user's back faces the support post 17 while in a sitting position. By placing the user's toes through the handles 79, the user can now move the carriage 43 back and forth along rail 13 to develop calf and thigh muscles. Further, the handle 79 can be replaced by a head harness (not shown) adapted to attach the users head to the cord 73. In this manner, the user may improve neck muscles.

It will thus be seen that different exercises can be performed using the exercise device 11 depending upon how the user positions himself upon the cushioned board 45. For example, a variety of different exercises can be performed depending upon whether the user is sitting, kneeling or laying on his back or stomach on the board 45. Exercie routines can therefore be set up for developing the arms, abdominable regions, legs. etc.

When the auxiliary legs 37 are surmounted above the support board 45, the user may grasp handles 39 in order to perform dipping-type push-up exercises. Further when the auxiliary legs 37 are attached to the mounting means 31 to suitate the rail 13 in a substantially horizontal configuration, the user may lie upon the support board 45 and utilize the exercising device 11 as a weight lifting bench in order to perform bench practice as well as a variety of sit-up exercises.

By attaching the rail structure 13 to the support post 17 at different angles of inclination, the force required to move the body weight can be adjusted. Angle setting on the support post 17 can be such that an exercise is not too strenuous, but is correct for the individual's capabilities. The rail 13 may be nearly level, and useful in therapeutic rehabilitation of people suffering from accidents or sickness. The device may be adjusted so that an incapacitated person can exercise to a limited degree.

Many exercises are accomplished with the present invention while in the sitting or prone position. It has an important advantage over many exercise devises in that no energy is required to maintain balance. All the needed energy is concentrated on the exact muscles that one is trying to strengthen, develop or contour.

While the invention has been particularly shown and described with reference to preferred embodiments thereof, it will be understood by those skilled in the art that various changes in form and detail may be made therein without departing from the spirit and scope of the invention as defined in the appended claims.

I claim:

1. An exercise device comprising:

(a) a single elongated carriage mounting rail;

(b) a support post positioned at one free end of said rail for supporting said one end of said rail at selected elevations;

(c) a user supporting carriage having rollers engaging said rail for travelling along said rail;

(d) pulley means including pulleys attached to said post and lines extending through said pulleys from said carriage and back to said carriage for moving said carriage along said rail;

(e) mounting means for mounting auxiliary support legs which support the end of said rail opposite the end supported by said post at a fixed elevation; and (f) means for supporting a bar bell, said bar bell support means being connected directly to said mounting means in surmounting relation to said rail.

2. An exercise device as set forth in claim 1 wherein said mounting means includes means for supporting a handle in a position surmounting said rail.

3. An exercise device comprising:

(a) a single elongated carriage mounting rail;

(b) a support post positioned at one free end of said rail for supporting one end of said rail at selected elevations:

(c) a user supporting carriage having rollers engaging said rail for travelling along said rail;

(d) pulley means including pulleys attached to said post and lines extending through said pulleys from said carriage and back to said carriage for moving said carriage along said rail; and (e) a head harness attached to the ends of said lines.

4. An exercise device as set forth in claim 3 or 1 wherein said carriage further includes: a frame; a body support surface pivotally mounted to said frame; and means for selectively varying the angle between said surface and said frame, wherein said rollers are connected to said frame for supporting said frame on said rail whereby said frame travels along said rail.

5. An exercise device as set forth in claim 3 or 1 including foot holders pivotally mounted to said post and said holders include means for securing the foot of a user.

6. An exercise device as set forth in claim 3 or 1 wherein said rail is formed from a plurality of pieces, and including means for connecting said pieces such that said rail can be collapsed.

7. An exercise device as set forth in claim 3 or 1 and further including detachable handles connected to ends of said lines.

8. An exercise device comprising:

(a) a support assembly having only one elongated mounting rail with two ends, only one support post, and means for mounting said mounting rail at selected positions on said support post; said rail mounting means including only one sleeve connected to one end of said rail, said post being received in said sleeve, and means for supporting said sleeve on said support post;

(b) a user supporting carriage having a plurality of wheels engaging said mounting rail for moving said carriage longitudinally along said mounting rail; and (c) pulley means including pulleys attached to said post and lines extending through said pulleys from said carriage and back to said carriage for moving said carraige along said mounting rail upon exertion on the lines by a user positioned on the carriage.

9. The exercise device as set forth in claim 8 wherein said mounting rail comprises two sections, and means for connecting said two sections.

10. The exercise device as set forth in claim 8 wherein said mounting rail has a top surface and two side surfaces, and said wheels include at least one wheel engaging each side surface, respectively, of said mounting rail, and at least one wheel engaging said top surface of said mounting rail.

11. The exercise device as set forth in claim 8 and further including leg mounting means attached to said rail for attaching auxiliary legs to said rail at a position spaced from said post along said rail and at least one auxiliary leg for connection to said leg mounting means, and wherein said rail mounting means includes at least one selected position at which said support post cooperates with said auxiliary leg to hold said mounting rail in a generally horizontal position.

12. The exercise device as set forth in claim 11 wherein said leg mounting means includes means for supporting handles in a position surmounting said mounting rail.

13. The exercise device as set forth in claim 8 and further including handles attached to the ends of said lines.

* * * * *